US009208932B2

(12) United States Patent
Igarashi

(10) Patent No.: US 9,208,932 B2
(45) Date of Patent: Dec. 8, 2015

(54) MAGNETIC POWDER, FORMING METHOD THEREOF AND MAGNETIC SHEET

(71) Applicant: NEC TOKIN CORPORATION, Sendai-shi, Miyagi (JP)

(72) Inventor: Toshiyuki Igarashi, Sendai (JP)

(73) Assignee: NEC TOKIN CORPORATION, Sendai-shi, Miyagi (JP)

( * ) Notice: Subject to any disclaimer, the term of this patent is extended or adjusted under 35 U.S.C. 154(b) by 160 days.

(21) Appl. No.: 14/045,285

(22) Filed: Oct. 3, 2013

(65) Prior Publication Data

US 2014/0097377 A1 Apr. 10, 2014

(30) Foreign Application Priority Data

Oct. 5, 2012 (JP) ..... 2012-222854

(51) Int. Cl.

| | |
|---|---|
| ***H01F 1/24*** | (2006.01) |
| ***H01F 1/00*** | (2006.01) |
| ***H01F 1/153*** | (2006.01) |
| ***H01F 1/28*** | (2006.01) |
| ***H01F 1/20*** | (2006.01) |
| ***H01F 1/26*** | (2006.01) |
| ***H01F 1/33*** | (2006.01) |
| ***B22F 1/00*** | (2006.01) |
| ***B22F 1/02*** | (2006.01) |
| ***B22F 5/00*** | (2006.01) |
| ***B22F 9/00*** | (2006.01) |
| *B22F 9/04* | (2006.01) |

(52) U.S. Cl.

CPC ..... *H01F 1/0027* (2013.01); *B22F 1/0055* (2013.01); *B22F 1/02* (2013.01); *B22F 5/006* (2013.01); *B22F 9/002* (2013.01); *H01F 1/15383* (2013.01); *H01F 1/20* (2013.01); *H01F 1/26* (2013.01); *H01F 1/28* (2013.01); *H01F 1/33* (2013.01); *B22F 2009/047* (2013.01); *B22F 2999/00* (2013.01); *H01F 1/15375* (2013.01); *H01F 1/24* (2013.01); *Y10T 428/2991* (2015.01)

(58) Field of Classification Search

CPC .... B22F 2009/047; B22F 1/02; B22F 1/0055; H01F 1/28; H01F 1/20; H01F 1/15383

See application file for complete search history.

(56) References Cited

FOREIGN PATENT DOCUMENTS

| | | |
|---|---|---|
| JP | 10-92621 A | 4/1998 |
| JP | 2002-050511 A | 2/2002 |

*Primary Examiner* — Carol M Koslow

(74) *Attorney, Agent, or Firm* — Holtz, Holtz, Goodman & Chick PC

(57) ABSTRACT

A magnetic powder comprises a first magnetic particle, one or more inorganic insulating particles and one or more second magnetic particles. The first magnetic particle is made of a soft magnetic metal. The first magnetic particle has a flat shape. The inorganic insulating particles are attached to the first magnetic particle. The inorganic insulating particles partially cover the first magnetic particle. Each of the second magnetic particles is made of a soft magnetic metal. Each of the second magnetic particles has a flat shape. The second magnetic particles are attached to the first magnetic particle via the inorganic insulating particles.

10 Claims, 3 Drawing Sheets

MAGNETIC POWDER, FORMING METHOD THEREOF AND MAGNETIC SHEET

CROSS REFERENCE TO RELATED APPLICATIONS

An Applicant claims priority under 35 U.S.C. §119 of Japanese Patent Application No. JP2012-222854 filed Oct. 5, 2012.

BACKGROUND OF THE INVENTION

This invention relates to a magnetic powder mainly formed of a magnetic particle made of a soft magnetic metal and having a flat shape.

A composite magnet is used to prevent an electromagnetic interference caused by an electronic device. The composite magnet is typically made of magnetic powder particles and a binder binding the magnetic powder particles. The binder is made of a polymer. Each of the magnetic powder particles is made of a soft magnetic metal. Moreover, each of the magnetic powder particles has a flat shape so as to have an improved magnetic permeability due to the flat shape. Recently, as the electronic device is required to work at higher frequency, the composite magnet is required to correspond to wider frequency range.

For example, a technique related to the composite magnet is disclosed in each of JP-A H10 (1998)-92621 (Patent Document 1) and JP-A 2002-050511 (Patent Document 2), contents of which are incorporated herein by reference.

Patent Document 1 discloses a composite magnet including flat magnetic particles and a binder. Each of the flat magnetic particles has a surface coated with fine particles. According to Patent Document 1, the thus-formed composite magnet has not only a higher electrical resistance but also a higher magnetic permeability at high frequency.

Patent Document 2 discloses a soft magnetic material made of magnetic particles and glass fine particles. Each of the magnetic particles is made of a soft magnetic metal. The glass fine particles are pressed against and attached to the surfaces of the magnetic particles by pressure and friction force. According to Patent Document 2, the thus-formed soft magnetic material has sufficient insulating properties.

When the flat magnetic powder particles of Patent Document 1 are coated with the fine particles, some of the flat magnetic powder particles may be stacked on one another. Each of the thus-stacked flat magnetic powder particles has an exposed surface and an unexposed surface. Only the exposed surface of the magnetic powder particle is coated with the fine particles. In order to completely coat the unexposed surfaces, it is necessary to stir the flat magnetic powder particles repeatedly after the coating process. It takes too much time to coat all of the flat magnetic powder particles. Thus, the technique disclosed in Patent Document 1 has a problem in mass productivity.

Patent Document 2 only discloses a method for attaching the glass fine particles to the magnetic particles by using a surface improving device. Patent Document 2 does not disclose a method for obtaining a flat shaped magnetic particle. In detail, the magnetic particles of Patent Document 2 are pressed so as to be attached with the glass fine particles. The pressed magnetic particles are stirred. The pressing and the stirring are performed repeatedly in the attaching process. Even if the magnetic particle has a flat shape before the attaching process, the flat shape may be deformed during the attaching process. Accordingly, the technique disclosed in Patent Document 2 is not suitable to obtain a flat magnetic powder.

SUMMARY OF THE INVENTION

It is therefore an object of the present invention to provide a magnetic powder mainly formed of a magnetic particle made of a soft magnetic metal and having a flat shape, wherein the magnetic powder having high electrical resistance and high mass productivity.

An aspect of the present invention provides a magnetic powder comprising a first magnetic particle, one or more inorganic insulating particles and one or more second magnetic particles. The first magnetic particle is made of a soft magnetic metal. The first magnetic particle has a flat shape. The inorganic insulating particles are attached to the first magnetic particle. The inorganic insulating particles partially cover the first magnetic particle. Each of the second magnetic particles is made of a soft magnetic metal. Each of the second magnetic particles has a flat shape. The second magnetic particles are attached to the first magnetic particle via the inorganic insulating particles.

Another aspect of the present invention provides a forming method of a magnetic powder comprising a first step, a second step and a third step. The first step is a step of preparing a mixture of a metal powder and an inorganic insulator. The metal powder is made of a soft magnetic metal. The inorganic insulator is made of a glass material. The second step is a step of putting the mixture into a flattening device. The third step is a step of flattening the metal powder by using the flattening device to obtain a magnetic particle which has a flat shape and is attached with one or more of inorganic insulating particles formed from the inorganic insulator.

Still another aspect of the present invention provides a magnetic sheet having flexibility. The magnetic sheet comprises a plurality of magnetic powder particles and a binder. Each of the magnetic powder particles includes a first magnetic particle made of a soft magnetic metal, one or more inorganic insulating particles and one or more second magnetic particles each made of a soft magnetic metal. The first magnetic particle has a flat shape. The inorganic insulating particles are attached to the first magnetic particle. The inorganic insulating particles partially cover the first magnetic particle. Each of the second magnetic particles has a flat shape. The second magnetic particles are attached to the first magnetic particle via the inorganic insulating particles. The binder is made of a polymer. The binder binds the magnetic powder particles so as to generate the flexibility of the magnetic sheet.

An appreciation of the objectives of the present invention and a more complete understanding of its structure may be had by studying the following description of the preferred embodiment and by referring to the accompanying drawings.

Figure 1:
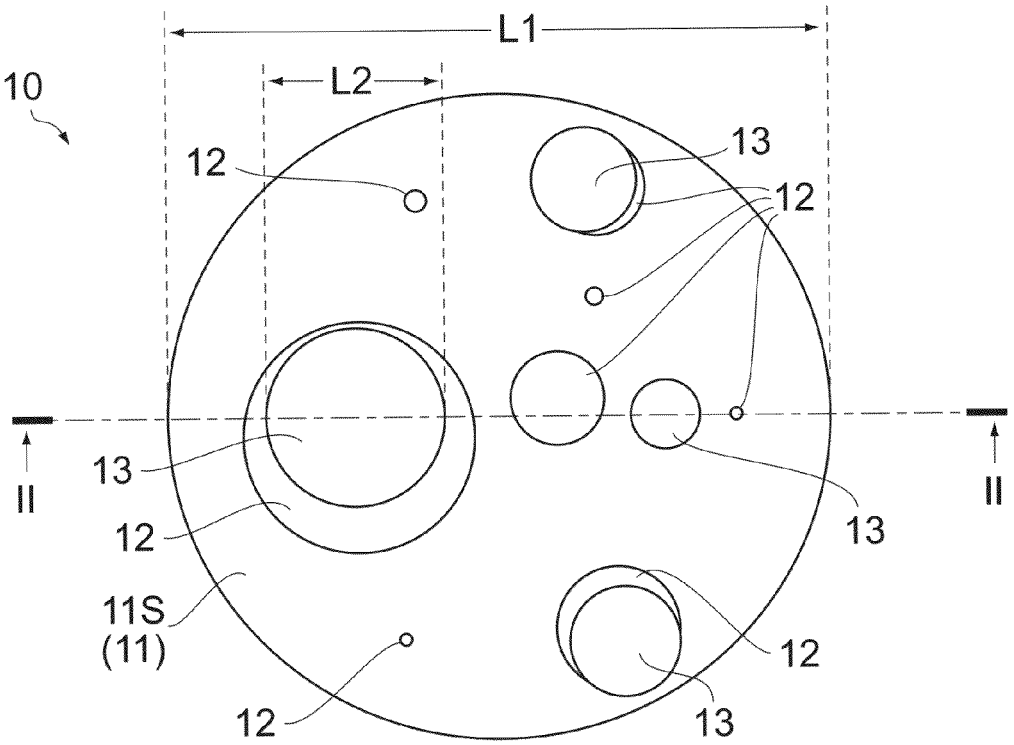
FIG. 1 is a plan view schematically showing a part of magnetic powder according to a first embodiment of the present invention.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

First Embodiment

Figure 2:
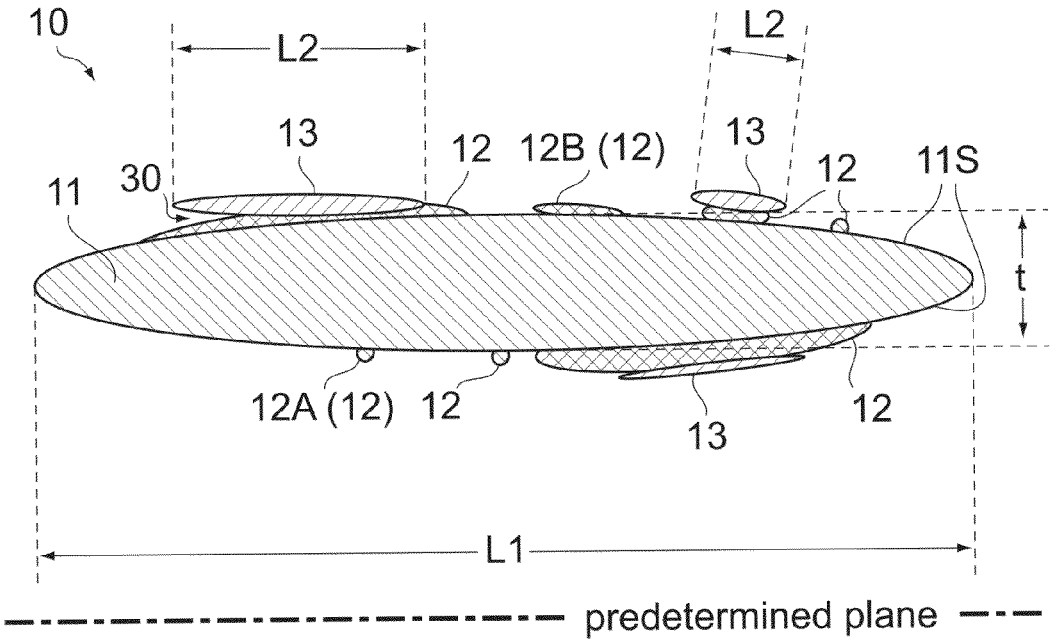
FIG. 2 is a cross-sectional view showing the magnetic powder of FIG. 1.

As shown in FIGS. 1 and 2, a magnetic powder (magnetic powder particle) 10 according to a first embodiment of the present invention comprises a first magnetic particle (magnetic particle) 11 made of a soft magnetic metal, one or more inorganic insulating particles 12 and one or more second magnetic particles (magnetic particles) 13 each made of a soft magnetic metal.

The first magnetic particle 11 has a flat shape with surfaces 11S. Each of the surfaces 11S illustrated in FIG. 2 is a curved surface. However, surface 11S may be a flat surface which is in parallel to a predetermined plane (see FIG. 2). In other words, the first magnetic particle 11 may extend in parallel to the predetermined plane. The inorganic insulating particles 12 are attached to the first magnetic particle 11. In detail, the inorganic insulating particles 12 include one or more inorganic insulating particles 12A and one or more inorganic insulating particles 12B. The inorganic insulating particle 12A has a granular shape. The inorganic insulating particle 12B is crushed to cover a part of the surface 118. Each of the inorganic insulating particles 12 partially covers the surfaces 118 of the first magnetic particle 11. Similar to the first magnetic particle 11, each of the second magnetic particles 13 has a flat shape. The second magnetic particles 13 are attached to the surfaces 11S of the first magnetic particle 11 via the respective inorganic insulating particles 12.

Figure 3:
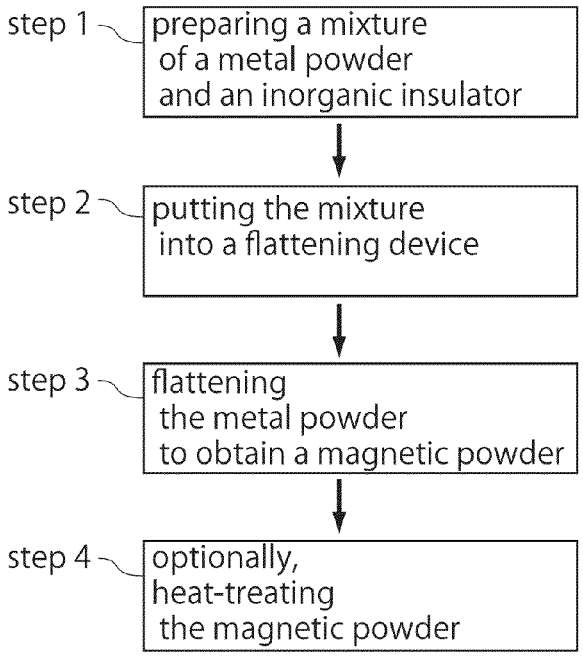
FIG. 3 is a flowchart showing a forming method of the magnetic powder of FIG. 1.

As shown in FIG. 3, the magnetic powder 10 shown in FIGS. 1 and 2 can be formed via the following forming method comprising the following steps.

In a first step, a mixture of a metal powder and an inorganic insulator is prepared. The metal powder is made of a soft magnetic metal. For example, the soft magnetic metal is an Fe-based amorphous metal which includes P, B, Nb and Cr. The metal powder includes a plurality of metal particles. Each of the metal particles may have a sphere-like shape. The inorganic insulator is made of a glass material. For example, the glass material is a phosphate glass. The inorganic insulator includes a plurality of granular particles.

In a second step, the mixture of the metal powder and the inorganic insulator is put into a flattening device. For example, the flattening device may be a bead mill, a ball mill or a medium stirring mill. The mixture may be mixed with a solvent before being put into the flattening device. In this case, the mixture which contains the solvent is put into, for example, the medium stirring mill.

In a third step, the metal particles of the metal powder are compressed and flattened by using the flattening device. Meanwhile, the surfaces of the metal particles are attached with the inorganic insulator. In detail, the flattened metal particles include the first magnetic particles 11 which are relatively large and the second magnetic particles 13 which are relatively small. The granular particles of the inorganic insulator are grinded into inorganic insulating particles 12 by a pressure that is larger than the breaking point of the granular particle. One or more of the inorganic insulating particles 12 are attached to the first magnetic particle 11 during the fattening process. Moreover, one or more of the second magnetic particles 13 are attached to the first magnetic particle 11 via the inorganic insulating particles 12 during the fattening process. Since the inorganic insulating particle 12 is thus sandwiched between the first magnetic particle 11 and the second magnetic particle 13, the inorganic insulating particle 12 connects the first magnetic particle 11 and the second magnetic particle 13 with each other. Thus, the first magnetic particle 11, which has a flat shape and is attached with one or more of the inorganic insulating particles 12 formed from the inorganic insulator, can be obtained. In other words, the magnetic powder 10 according to the present embodiment is formed.

When the inorganic insulator is made of a phosphate glass which has a softening point of between 350° C. and 450° C., the softening point of the inorganic insulator is low so that the inorganic insulator is easily softened in the third step. Accordingly, the inorganic insulating particles 12 are well attached to the first magnetic particle 11.

According to the aforementioned forming method, the magnetic powder 10 has an improved electric insulation because of the attached inorganic insulating particles 12. The inorganic insulating particles 12 are attached to the first magnetic particle 11 at the same time as the flattening process. Thus, the electric insulation of the magnetic powder 10 can be improved without another step of coating the inorganic insulating particles 12 on the first magnetic particle 11. The magnetic powder 10 according to the present embodiment has high electrical resistance and high mass productivity.

As can be seen from the aforementioned forming method, each of the first magnetic particle 11 and the second magnetic particle 13 may be made an amorphous metal while the inorganic insulating particle 12 may be made of a glass material. More specifically, each of the first magnetic particle 11 and the second magnetic particle 13 may be made of an Fe-based amorphous metal which includes P, B, Nb and Cr. The inorganic insulating particle 12 may be made of a phosphate glass material. In this case, a softening point of the inorganic insulating particle 12 is typically lower than a crystallization temperature of each of the first magnetic particle 11 and the second magnetic particle 13.

As shown in FIG. 3, when the softening point of the inorganic insulating particle 12 is lower than the crystallization temperature of each of the first magnetic particle 11 and the second magnetic particle 13, the forming method may comprise a fourth step. In the fourth step, the magnetic powders 10 are heat-treated mainly for improving the properties of the first magnetic particles 11.

In the fourth step, the magnetic powder 10 is heat-treated at a temperature which is a little lower than the crystallization temperature of each of the first magnetic particle 11 and the second magnetic particle 13. By adding the fourth step, the internal stress of the first magnetic particle 11 can be reduced. Moreover, the magnetic permeability of the first magnetic particle 11 can be improved.

When the magnetic powder 10 is heat-treated as described above, the inorganic insulating particles 12 are heat-treated at a temperature which is near to the softening point thereof. The inorganic insulating particle 12 is softened to spread more widely on the surfaces 11S of the first magnetic particle 11.

Thus, the area of the inorganic insulating particles 12 on the surfaces 11S of the first magnetic particle 11 becomes larger. Accordingly, the electric insulation of the magnetic powder 10 can be more improved.

As described above, the aforementioned heat-treating can improve not only the magnetic permeability but also the electric insulation of the first magnetic particle 11 at the same time.

Hereafter, it is described about various properties of the magnetic powder 10 including a plurality of the first magnetic particles 11.

As shown in FIGS. 1 and 2, the first magnetic particle 11 is larger than the second magnetic particle 13. In detail, each the first magnetic particles 11 has a first cross-section perpendicular to the flat shape of the first magnetic particle. In other words, the first cross-section is perpendicular to the predetermined plane. The first cross-section includes a first major axis (diameter) that is longer than any other line included in the first magnetic particle 11. The first major axis has a first major length (L1). Similarly, each of the second magnetic particles 13 has a second major axis (diameter) that is longer than any other line included in the second magnetic particle 13. The second major axis has a second major length (L2). The second cross-sections illustrated in FIG. 2 are located in a plane that includes the first cross-section. However, the second cross-section may be located in a plane that does not include the first cross-section. The first major length (L1) is longer than the second major length (L2) of each of the second magnetic particles 13 attached to the first magnetic particle 11. According to the present embodiment, an average of ratios, each of which is a ratio of the second major length (L2) to the first major length (L1), is smaller than 1/2. More specifically, the average of the ratios is smaller than 1/10.

The aforementioned condition between the first major length (L1) and the second major length (L2) can be obtained, for example, by using the medium stirring mill as the flattening device. In other words, the magnetic powder 10 formed in the medium stirring mill meet the aforementioned condition. If the second magnetic particle 13 attached to the first magnetic particle 11 has a nearly same size as the first magnetic particle 11, the magnetic powder 10 becomes too large. When the thus-enlarged magnetic powder 10 is used to form a magnetic sheet, the magnetic sheet has large gaps each of which is formed between the first magnetic particles 11. Accordingly, the magnetic sheet has a lowered filling ratio of the magnetic powder 10 and the magnetic permeability of the magnetic sheet is lowered. The magnetic powder 10 according to the present embodiment can solve these problems.

As shown in FIG. 2, the first cross-section has a first thickness (t) in a direction perpendicular to the predetermined plane. It is preferable that an average of the first major lengths (L1) of the first magnetic particles 11 included in the magnetic powder 10 is between 10 μm and 120 μm both inclusive. Moreover, an average of ratios, each of which is a ratio of the first major length (L1) to the first minor length (t), is between 10 and 100 both inclusive. The magnetic powder 10 that meets the aforementioned condition can be obtained, for example, by adjusting the pressure upon the compression of the metal powder under the flattening process. The magnetic powder 10 which meets the aforementioned condition sufficiently utilizes the magnetic permeability of the first magnetic particles 11.

As can be seen from the aforementioned forming method according to the present embodiment, the first magnetic particle 11 has a composition same as a composition of the second magnetic particle 13. In other words, the first magnetic particle 11 is made of the practically same material as the second magnetic particle 13. The aforementioned word "practically same" means that even if the composition of the first magnetic particle 11 is slightly different from the composition of the second magnetic particle 13, the difference is equal to or less than the variation of compositions in the common lot of productive material.

The second magnetic particle 13 may have the composition practically different from the composition of the first magnetic particle 11, for example, by mixing two kinds of metal powders in the first step of the forming method.

The thickness of the inorganic insulating particle 12 can be changed, for example, by adjusting the pressure upon the compression of the metal powders under the flattening process. For example, in order to sufficiently improve the electric insulation of the magnetic powder 10, it is preferable that the thickness of the inorganic insulating particle 12 attached to the first magnetic particle 11 is 1 nm or more. The thickness is more preferable to be 10 nm or more.

However, if the thickness of the inorganic insulating particle 12 is too large, a ratio of the first magnetic particles 11 and the second magnetic particles 13 included in the magnetic sheet is lowered when the magnetic powder 10 is filled in the magnetic sheet. Accordingly, the magnet permeability of the magnetic sheet might be degraded. When the magnet permeability of the magnetic sheet is required to be improved, the thickness of the inorganic insulating particle 12 is preferable to be 100 nm or less. The thickness is more preferable to be 60 nm or more. The thickness is still more preferable to be 30 nm or more.

The weight ratio of the inorganic insulating particles 12 to the magnetic powder 10 can be changed by changing the amount of the metal powder and the amount of the inorganic insulator in the first step of the forming method. When the magnetic powder 10 is required to have the sufficient electric insulation, the weight ratio of the inorganic insulating particles 12 is desirable to be 2.5% or more. When the magnetic permeability of the magnetic powder 10 is required not to be degraded, the weight ratio of the inorganic insulating particles 12 is desirable to be 10.0% or less.

Second Embodiment

Figure 4:
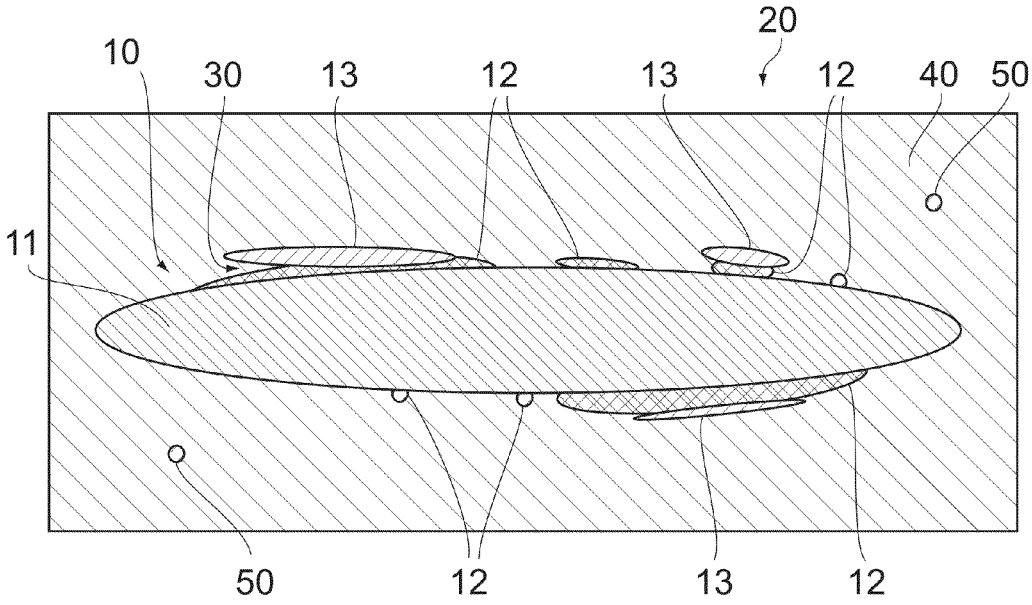
FIG. 4 is a cross-sectional view schematically showing a part of a magnetic sheet according to a second embodiment of the present invention.

As shown in FIG. 4, a magnetic sheet 20 according to a second embodiment of the present invention comprises a plurality of the magnetic powder particles 10 and a binder 40 made of a polymer. The magnetic sheet 20 has flexibility. The binder 40 binds the magnetic powder particles 10 so as to generate the flexibility of the magnetic sheet 20.

The magnetic sheet 20 shown in FIG. 4 can be formed via the following steps.

At first, the magnetic powder 10 according to the first embodiment is mixed with a liquid binder. Then, the binder, which includes the magnetic powder 10, is deposited to form a sheet. Then, the sheet of the binder is solidified to become the binder 40 so that the magnetic sheet 20 is formed. The binder 40 is made of a polymer so that the flexibility of the magnetic sheet 20 can be obtained.

The liquid binder can be solidified by using various methods. For example, the liquid binder including the magnetic powder 10 may be mixed with an organic solvent. Subsequently, the organic solvent is evaporated so that the solidified binder 40 is obtained. For another example, the liquid binder may be a monomer. In this case, the liquid binder can be solidified via polymerization reaction.

As shown in FIGS. 2 and 4, the magnetic powder particle 10 is generally formed with a gap 30. The gap 30 is formed, for example, between a peripheral part of the inorganic insulating particle 12 and a peripheral part of the second magnetic particle 13. The liquid binder can fill the gap 30. When the liquid binder is solidified, the gap 30 is filled with the binder 40 so that the magnetic powder particle 10 is securely bound to the binder 40. In other words, the binding power between the magnetic powder particle 10 and the binder 40 increases due to the anchor effect. Accordingly, the magnetic sheet 20 can be more easily shaped into a desired shape. Moreover, the magnetic powder particle 10 is preventable from falling out of the binder 40.

The thus-formed magnetic sheet 20 shows a magnetic permeability that maximally utilizes the magnetic permeability of the magnetic powder 10. Moreover, the magnetic powder 10 of the magnetic sheet 20 have the high electric insulation so that an eddy current is hardly to be generated. Accordingly, the magnetic permeability of the magnetic sheet 20 is prevented from being lowered at high frequency because of the eddy current.

As shown in FIG. 4, the binder 40 according to the present embodiment generally contains granular inorganic insulating particles 50 separated from the first magnetic particle 11. The granular inorganic insulating particles 50 are distributed in the binder 40. In other words, the magnetic sheet 20 according to the present embodiment further comprises the granular inorganic insulating particle 50.

As shown in FIGS. 2 and 4, some of the inorganic insulating particles 12 are not attached with the second magnetic particles 13. Hereafter, this type of the inorganic insulating particle 12 is referred to as the isolated inorganic insulating particle 12. Generally, an average number (AVi) of the isolated inorganic insulating particles 12 per the one first magnetic particle 11 is one or more. When the average number (AVi) is too large, the binding power between the magnetic powder particle 10 and the binder 40 might be degraded since the isolated inorganic insulating particles 12 tend to repel the liquid binder.

The average number (AVi) can be adjusted to a predetermined value by adjusting the amount of the inorganic insulator of the mixture that is prepared in the first step of the forming method of the magnetic powder 10. It is desirable that the average number (AVi) is less than one hundred. It is more desirable that the average number (AVi) is less than fifty. It is still more desirable that the average number (AVi) is less than twenty.

As shown FIGS. 2 and 4, the inorganic insulating particles 12 are attached to the cross-section of the first magnetic particle 11 (i.e., the inorganic insulating particles 12 are attached to the surface 11S along the cross-section). The desirable average number (AVi) can be defined by the number (N) of the inorganic insulating particles 12 which are attached to the cross-section of the first magnetic particle 11. Specifically, it is desirable that the number (N) is one to twenty nine. It is more desirable that the number (N) is less than twenty. It is still more desirable that the number (N) is less than ten.

An average number (AVs) of the second magnetic particles 13 per the one first magnetic particle 11 is required to be equal to or more than one so that the sufficient anchor effect can be obtained. However, when the average number (AVs) is too large, the magnetic permeability of the magnetic sheet 20 might be lowered. Similar to the average number (AVi), the average number (AVs) can be adjusted to a predetermined value. Specifically, it is desirable that the average number (AVs) is less than one hundred. It is more desirable that the average number (AVs) is less than fifty. It is still more desirable that the average number (AVs) is less than twenty.

Similar to the average number (AVi), the desirable average number (AVs) can be defined by the number (Ns) of the second magnetic particles 13 attached to the cross-section of the first magnetic particle 11 via the inorganic insulating particles 12 (i.e., the number of second magnetic particles 13 attached to the surface 11S along the cross-section via the inorganic insulating particles 12). Specifically, it is desirable that the number (Ns) is one to twenty nine. It is more desirable that the number (Ns) is less than twenty. It is still more desirable that the number (Ns) is less than ten.

EXAMPLES

A mixture of metal powder particles and an inorganic insulator was prepared. The metal powder particle was made of an amorphous Fe—P—B—Nb—Cr alloy. Each of the metal powders had a sphere-like shape and soft magnetism. The inorganic insulator was a glass frit made of a phosphate. The phosphate was an oxide including Si, Al, P, Na, K, Ca, Zn and Sb. The metal powder particles and the inorganic insulator were mixed with a solvent so that the mixture (i.e. mix powder) of the metal powder particles and the inorganic insulator was obtained.

The metal powder particle had a crystallization temperature of 490° C. The inorganic insulator had a softening point of 365° C.

(Putting the Mixture of Example 1 in a Flattening Device)

The mix powder including the solvent was put into a ball mill.

(Flattening the Metal Powder Particles of Example 1)

The metal powder particles of the mix powder were flattened by using the ball mill so that magnetic particles (first magnetic particles 11 and second magnetic particles 13) each having a flat shape were formed. The average of the particle diameters of the magnetic particles was 20 μm. Meanwhile, the inorganic insulator of the mix powder was grinded into inorganic insulating particles 12. The inorganic insulating particles 12 included inorganic insulating particles 12A each of which had a granular shape and inorganic insulating particles 12B each of which had a crushed shape. Each of the first magnetic particles 11 was attached with the inorganic insulating particles 12 and the second magnetic particles 13 during the flattening process so that the magnetic powder 10 was formed.

Figure 5:
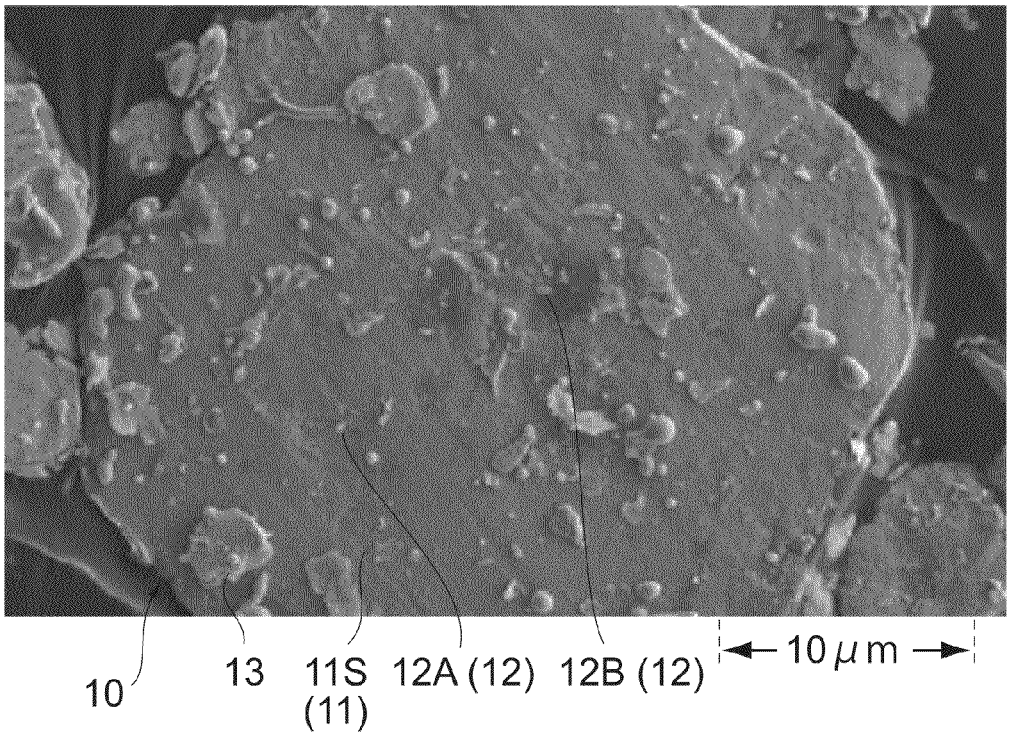
FIG. 5 is a copy of picture showing Example of the magnetic powder according to the first embodiment, wherein the picture is taken by using a Scanning Electron Microscope (SEM).

As shown in FIG. 5, the thus-formed magnetic powder 10 included the first magnetic particle 11, a plurality of the inorganic insulating particles 12 and a plurality of the second magnetic particles 13. In detail, the inorganic insulating particles 12A and 12B were attached to the surface 11S of the first magnetic particle 11. Moreover, the second magnetic particles 13 were attached to the first magnetic particle 11 via the inorganic insulating particles 12.

(Forming a Magnetic Sheet of Example 1)

The magnetic powder 10 was mixed with a liquid binder made of an acrylic rubber. Then, the binder, which contained the magnetic powder 10, was deposited to form a sheet. Then, the sheet of the binder was solidified so that the magnetic sheet 20 of Example 1 was formed.

(Forming a Magnetic Sheet of Example 2)

The obtained magnetic powder 10 (see FIG. 5) was heat-treated at 400° C. which is higher than the softening point of the inorganic insulator and is lower than the crystallization temperature of the metal powder particle. Then, the heat-treated magnetic powder 10 was mixed with a liquid binder made of an acrylic rubber. Then, a magnetic sheet of Example 2 was formed similar to the magnetic sheet of Example 1.

(Forming a Magnetic Sheet of Comparative Example 1)

The metal powder particles of Example 1 were mixed with a solvent while the inorganic insulator of Example 1 was not mixed. Then, the metal powder particles were put into the ball mill together with the solvent. Then, similar to Example 1, the metal powder particles were flattened. The flattened metal powder particles were mixed with a liquid binder made of an acrylic rubber. Then, a magnetic sheet of Comparative Example 1 was formed similar to the magnetic sheet of Example 1.

(Measurement)

A sheet resistance (Rs) of the magnetic sheet of each of Example 1, Example 2 and Comparative Example 1 was measured. The magnetic sheet of Example 1 had a sheet resistance (Rs) of $1\times10^6$ Ω/sq. The magnetic sheet of Example 2 had a sheet resistance (Rs) of $4\times10^7$ Ω/sq. The magnetic sheet of Comparative Example 1 had a sheet resistance (Rs) of $8\times10^4$ Ω/sq. It was understood that the magnetic sheet had an improved resistance by attaching the inorganic insulating particles to the magnetic particles. Moreover, it was understood that the magnetic sheet had a further improved resistance by heat-treating the metal powder particles.

The present application is based on a Japanese patent application of JP2012-222854 filed before the Japan Patent Office on Oct. 5, 2012, the content of which is incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A magnetic powder comprising:

a first magnetic particle made of a soft magnetic metal, the first magnetic particle having a flat shape;

one or more inorganic insulating particles attached to the first magnetic particle, the inorganic insulating particles partially covering the first magnetic particle; and one or more second magnetic particles each made of a soft magnetic metal, each of the second magnetic particles having a flat shape, the second magnetic particles being attached to the first magnetic particle via the inorganic insulating particles.

2. The magnetic powder as recited in claim 1, wherein the first magnetic particle has a composition same as a composition of the second magnetic particle.

3. The magnetic powder as recited in claim 1, wherein:

the first magnetic particle has a first major axis which is longer than any other line included in the first magnetic particle, the first major axis having a first major length;

each of the second magnetic particles has a second major axis which is longer than any other line included in the second magnetic particle, the second major axis having a second major length; and an average of ratios, each of which is a ratio of the second major length to the first major length, is smaller than 1/2.

4. The magnetic powder as recited in claim 1, wherein:

the first magnetic particle has a cross-section perpendicular to the flat shape of the first magnetic particle, the cross-section including a first major axis which is longer than any other line included in the first magnetic particle; and one to twenty nine of the inorganic insulating particles are attached to the cross-section of the first magnetic particle.

5. The magnetic powder as recited in claim 1, wherein:

the first magnetic particle has a cross-section perpendicular to the flat shape of the first magnetic particle, the cross-section including a first major axis which is longer than any other line included in the first magnetic particle; and one to twenty nine of the second magnetic particles are attached to the cross-section of the first magnetic particle via the inorganic insulating particles.

6. The magnetic powder as recited in claim 1, wherein:

each of the first magnetic particle and the second magnetic particle is made of an amorphous metal;

the inorganic insulating particle is made of a glass material; and a softening point of the inorganic insulating particle is lower than a crystallization temperature of each of the first magnetic particle and the second magnetic particle.

7. The magnetic powder as recited in claim 1, wherein:

each of the first magnetic particle and the second magnetic particle is made of an Fe-based amorphous metal including P, B, Nb and Cr; and the inorganic insulating particle is made of a phosphate glass material.

8. The magnetic powder as recited in claim 1, the magnetic powder comprising a plurality of the first magnetic particles, wherein:

each of the first magnetic particle has a cross-section perpendicular to the flat shape of the first magnetic particle, the cross-section including a first major axis which is longer than any other line included in the first magnetic particle, the first major axis having a first major length, the cross-section having a first thickness;

an average of the first major lengths is between 10 μm and 120 μm both inclusive; and an average of ratios, each of which is a ratio of the first major length to the first thickness, is between 10 and 100 both inclusive.

9. A forming method of a magnetic powder comprising:

preparing a mixture of a metal powder and an inorganic insulator, the metal powder being made of a soft magnetic metal, the inorganic insulator being made of a glass material;

putting the mixture into a flattening device; and flattening the metal powder by using the flattening device to obtain a magnetic particle which has a flat shape and is attached with one or more of inorganic insulating particles formed from the inorganic insulator.

10. A magnetic sheet having flexibility, the magnetic sheet comprising:

a plurality of magnetic powder particles, each of the magnetic powder particles including a first magnetic particle made of a soft magnetic metal, one or more inorganic insulating particles and one or more second magnetic particles each made of a soft magnetic metal, the first magnetic particle having a flat shape, the inorganic insulating particles being attached to the first magnetic particle, the inorganic insulating particles partially covering the first magnetic particle, each of the second magnetic particles having a flat shape, the second magnetic particles being attached to the first magnetic particle via the inorganic insulating particles; and a binder made of a polymer, the binder binding the magnetic powder particles so as to generate the flexibility of the magnetic sheet.

* * * * *